United States Patent [19]

Pan

[11] 4,396,833

[45] Aug. 2, 1983

[54] OPTOMICROWAVE INTEGRATED CIRCUIT

[75] Inventor: Jing-Jong Pan, Melbourne, Fla.

[73] Assignee: Harris Corporation, Melbourne, Fla.

[21] Appl. No.: 227,373

[22] Filed: Jan. 22, 1981

[51] Int. Cl.[3] ..... H01J 40/14

[52] U.S. Cl. ..... 250/211 J; 357/30

[58] Field of Search ..... 250/211 R, 211 J, 215; 357/15, 30, 29, 22, 47–50

[56] References Cited

U.S. PATENT DOCUMENTS

| | | | |
|---|---|---|---|
| 3,917,943 | 11/1975 | Auston | 250/211 J |
| 3,931,633 | 1/1976 | Shannon et al. | 357/22 |
| 4,075,651 | 2/1978 | James | 357/22 |
| 4,326,210 | 4/1982 | Aso et al. | 357/30 |

*Primary Examiner*—David C. Nelms

*Attorney, Agent, or Firm*—Antonelli, Terry & Wands

[57] ABSTRACT

An optically controlled integrated circuit device for microwave signalling/switching is configured of a microstrip structure formed on a thin layer of active semiconductor material, such as doped GaAs or silicon, that is disposed atop an insulator substrate. A gap is provided in the conductive strip and radiant energy is directed onto the exposed surface of the active layer therebeneath for the purpose of bridging the gap via a surface-generated charge carrier region.

Electrical off-mode isolation in the gap is obtained by a narrow ribbon of conductive material disposed on the surface of the thin active layer at the gap between separated ends of the microstrip. This narrow ribbon is connected to a bias potential (e.g. ground), to create an isolation-enhancing depletion region in that portion of the active layer directly beneath the narrow ribbon. The thus generated depletion region provides input-/output isolation in the gap between the separated ends of the microstrip.

To turn the switch on, the gap is illuminated with a beam of light, in response to which electron-hole pairs in the semiconductor material of the active layer are generated. This generation of electron-hole pairs increases the carrier concentration, reduces the cross-sectional area of the depletion region and increases current flow in the gap, so that the separated ends of the microstrip are effectively electrically connected. To turn the device off, the beam of light is extinguished, cancelling the photo generated carrier and restoring the isolating depletion region.

31 Claims, 4 Drawing Figures

OPTOMICROWAVE INTEGRATED CIRCUIT

FIELD OF THE INVENTION

The present invention relates to the field of semiconductor apparatus and, more particularly, to optically controlled semiconductor devices for switching or modifying electrical signals, especially microwave signals.

BACKGROUND OF THE INVENTION

Over the last two decades, the electronics industry has witnessed rapid development and expansion of new devices and entire technologies evolving from the devices themselves. For example, efforts to reduce cost, size, power consumption, and improve on speed, bandwidth, isolation, etc., of components and systems have resulted in the development of integrated circuits and their evolution into LSI, VLSI, and IOC (integrated optic circuits), the latter employing optical dielectric waveguides.

Within this sector of component development, a number of optically responsive devices, such as light controlled switching devices (e.g. thyristors, optically responsive FETs, etc.) have been proposed. One such switch device which is purported to have particular utility in switching signals at microwave frequencies is described in the U.S. patent to Auston, U.S. Pat. No. 3,917,943.

In accordance with the proposed device, a microstrip configuration having a gap in a conductive strip that forms the signal carrying path is selectively illuminated by a first beam of light for temporarily providing a high electrical conductivity region in the surface of the semiconductor bulk material between separated ends of the conductive strip, whereby the device is effectively turned-on, providing a signal carrying path through the conductive strip and the illuminated surface of the semiconductor bulk at the gap in the strip. To turn the device off, a second beam of light, to which the bulk responds, must be directed at the device, creating an effective short circuit from the conductive strip, through the bulk itself, to a ground plane disposed on the bulk material.

Unfortunately, because of its configuration and mode of operation, this device requires considerable driving power (on the order of several watts) to trigger the switch, is subject to cross talk problems and has limited bandwidth (as separate switching control signals are required for turning the switch on and off).

SUMMARY OF THE INVENTION

In accordance with the present invention, there is provided a new and improved optically responsive integrated circuit device especially useful for microwave signalling/switching applications. In one embodiment of the inventive optically controlled microwave switch, a microstrip structure is formed on a thin layer of active semiconductor material, such as doped GaAs or silicon, that is disposed atop an insulator substrate. Like the conductor highway structure of the device described in the above-referenced patent to Auston, there is a gap formed in the conductive strip and radiant energy is directed onto the exposed surface of the active layer therebeneath for the purpose of bridging the gap via a surface-generated charge carrier region. However, here the similarity ends. Pursuant to the present invention, electrical isolation, not afforded by the Auston approach, is provided together with an increase in switching speed, as only a single light beam is required for on-off switching, with the device itself being formed of a thin active semiconductor layer as opposed to a relatively thick bulk material as in the Auston switch.

The isolation may take the form of a narrow ribbon of conductive material disposed on the surface of the thin active layer at the gap between separated ends of the microstrip. This narrow ribbon is connected to a bias potential (e.g. ground), to create an isolation-enhancing depletion region in that portion of the active layer directly beneath the narrow ribbon. The thus generated depletion region provides input/output isolation in the gap between the separated ends of the microstrip.

To turn the switch on, the gap is illuminated with a beam of light, in response to which electron-hole pairs in the semiconductor material of the active layer are generated, from the valence to the conduction band. This generation of electron-hole pairs increases the carrier concentration, reduces the cross-sectional area of the depletion region and increases current flow in the gap, so that the separated ends of the microstrip are effectively electrically connected. To turn the device off, the beam of light is extinguished, cancelling the photo generated carrier and restoring the isolating depletion region.

In place of the exclusive use of a generated narrow ribbon in the gap for input/output isolation, the switch device of the present invention may be configured so that, near the gap, each section of microstrip is further interrupted having a pair separated and adjacent narrow strips the extent or length of which are a quarter wavelength of the microwave frequency to be carried over the microstrip. That section of the microstrip defining the gap is coupled via a quarter wavelength termination strip to which a D.C. bias voltage is applied, thereby providing signal level compensation and R.F. isolation between separated sections of the microstrip.

In a further embodiment of the switch, both the input/isolation-providing grounded ribbon and the R.F. isolation sections may be provided for enhanced isolation between opposite ends of the strip.

DETAILED DESCRIPTION

Figure 1:
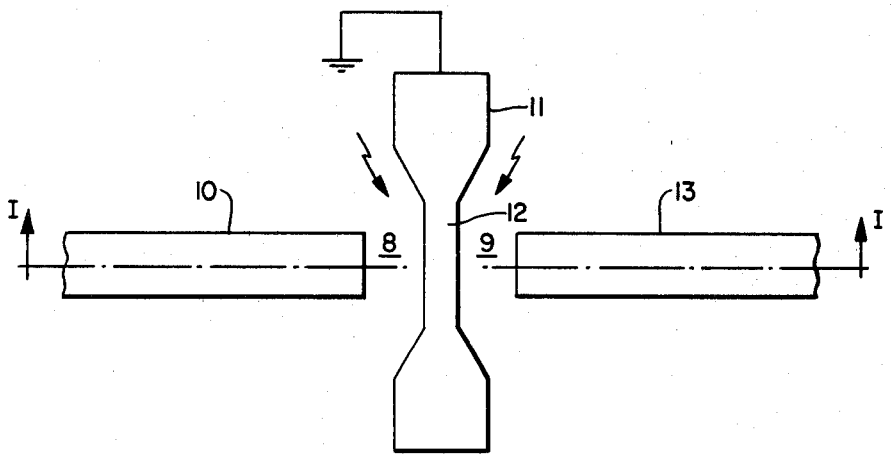
FIG. 1 is a plan view of a first embodiment of an optically controlled microwave switch in accordance with the present invention.
Figure 2:
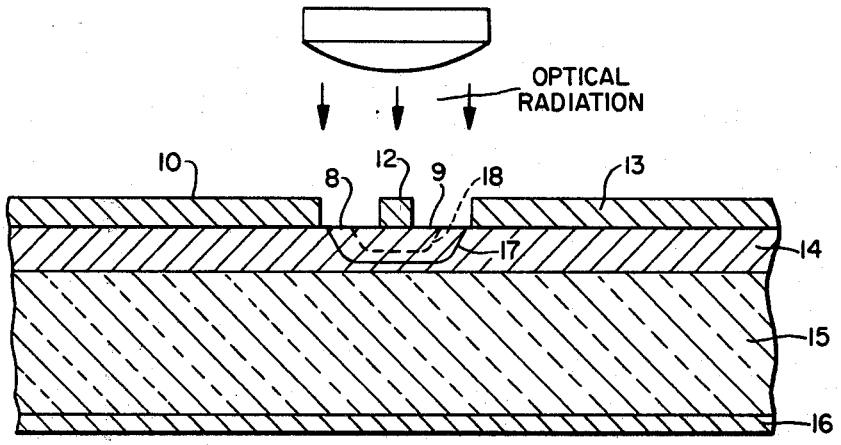
FIG. 2 is a sectional view of a microwave switch taken along line I—I of FIG. 1.

Referring now to FIGS. 1 and 2, there are illustrated respective plan and sectional views of a first embodiment of the present invention. The sectional view in FIG. 2 is taken along line I—I of FIG. 1. The optically controlled microstrip switch in the present embodiment comprises a microstripline conductor layer 10 disposed on the surface of a thin active semiconductor layer 14 which, in turn, is disposed upon an insulator substrate 15. Microstrip conductor 10 is spaced apart from another signal microstrip conductor layer 13 also disposed atop the active layer 14. On the bottom of the insulator substrate 15 is a conductor layer 16 such as a ground plane conductor layer.

The insulator substrate 15 may be comprised of gallium arsenide, silicon, saphire, fused silicon, or alumina, for example. Its thickness is not critical, so long as it provides support for the active layer and the thick microstrip conductor structure on its upper surface and provides a desired insulating thickness between the upper conductor structure and the lower conductor. The active layer 14 may be comprised of n-type gallium arsenide having an impurity concentration on the order of $2.5\times10^{17}cm^{-3}$. Although gallium arsenide is preferred as the active material, other materials such as silicon doped with gold, indium, or germanium at a concentration of $1\times10^{16}cm^{-3}$ may be employed. For operation in response to infrared radiation, materials such as indium phosphide, indium gallium arsenide, and indium phosphide/indium gallium arsenide may be employed for the active layer. The thickness of the active layer may be on the order of several tens of microns. What is required is that the total thickness of the structure between the respective conductive paths is chosen to support the microwave frequencies of interest. In this regard, atop the active layer the thickness of the microstrip conductor may be on the order of 0.5 microns for microwave operational frequencies above 8 GHz. For frequencies less than this limit, thicker metallization may be employed. The material of which the microstrip conductor is formed may be selected from a number of available conductive films, such as aluminum, Ti/Pt/Au, Au/Ge, In/Au/Ge, Ni/Au/Ge, Pt/Au/Ge, etc. The ground plane conductor 16 may be similarly formed so that the resultant thickness of the device is consistent with its intended operation for controllably transmitting microwave frequencies.

Within the gap that separates conductor sections 10 and 13 from each other, is a stripe-shaped conductor having a narrow ribbon portion 12 in the gap itself and wider flaring portions at the outer extremeties of the ribbon forming an input/output isolation-enhancing conductor 11. Conductor 11 itself is grounded, to form a depletion region 17 within the active layer 14. Between the edges of conductors 10 and 13 and the opposite edges of ribbon section 12 there is thus formed a pair of gaps 8 and 9 by way of which the surface of the active layer 14 may be selectively illuminated with light. Normally, in the absence of light, the grounded electrode 11 effectively forms a depletion region 17 which constricts the available cross-sectional area in the active layer 14 between opposing ends of the microstrip conductor sections 10 and 13, so that the signal path through the microstrip structure is effectively interrupted. When light is incident upon gaps 8 and 9, electron-hold pairs are created from the valence band to the conduction band within the active layer 14. This action increases the carrier concentration in the active layer 14 in the region of the gap illuminated by the light so that it effectively shrinks the depletion layer to a reduced size shown by the dotted lines 18 in FIG. 2. At the same time, photo-conductivity in the active layer 14 is increased, so that a current flow path between the ends of the microstrip conductors 10 and 13 within the active layer 14 beneath the produced depletion layer 18 is formed. As a result of this action, microstrip conductor sections 10 and 13 are effectively connected together providing a continuous signal path for the microwave signals of interest.

The wavelength of the light employed may be on the order of 0.4 to 0.9 μm for $G_aA_s$ (1.1 to 1.3 μm for $InP/I_nG_aA_s$). The width of the narrow ribbon 12 of the ground electrode 11 may be on the order of 0.5 to 3.0 μm and the separation of the edges of this electrode ribbon from the edges of the microstrip conductor sections 10 and 13 may be on the order of 1.0 to 3.0 μm. For a thickness of the active layer of 0.15 to 0.25 μm the depletion layer may typically extend to a depth of 0.1 μm. When illuminated by light of the above wavelength range, the depletion layer shrinks to a depth of 18 of only 0.08 to 0.02 μm.

To interrupt the microwave signal path through microstrip conductors 10 and 13 and the photo-generated connection within the active layer 14 at the region of the gap, the incident light beam is turned off, so that the generation of photo-current is terminated and the depletion region again expands to its original depth 17 providing a constricting isolation region within the active layer.

As compared to the configuration proposed in the patent to Auston, described above, the present invention offers operational simplicity and improved performance. Through the use of the depletion region-creating ribbon conductor in the gap, the need for separate light beams having different frequencies for turning the device on and off is obviated. Moreover, the entirety of the semiconductor structure need not be that of an active layer as in Auston, since, according to the present invention, the active layer may be considerably thin so as to simply provide a connection between the microstrip conductor sections 10 and 13, with an insulator substrate 15 providing the required support structure. This contrasts from the Auston configuration, wherein the thickness of the active layer is considerable, as it must provide both support structure and a light responsive shorting path between the upper surface of the bulk material and the round plane. By the use of a depletion region, the present invention offers both structural and operational advantages.

Figure 3:
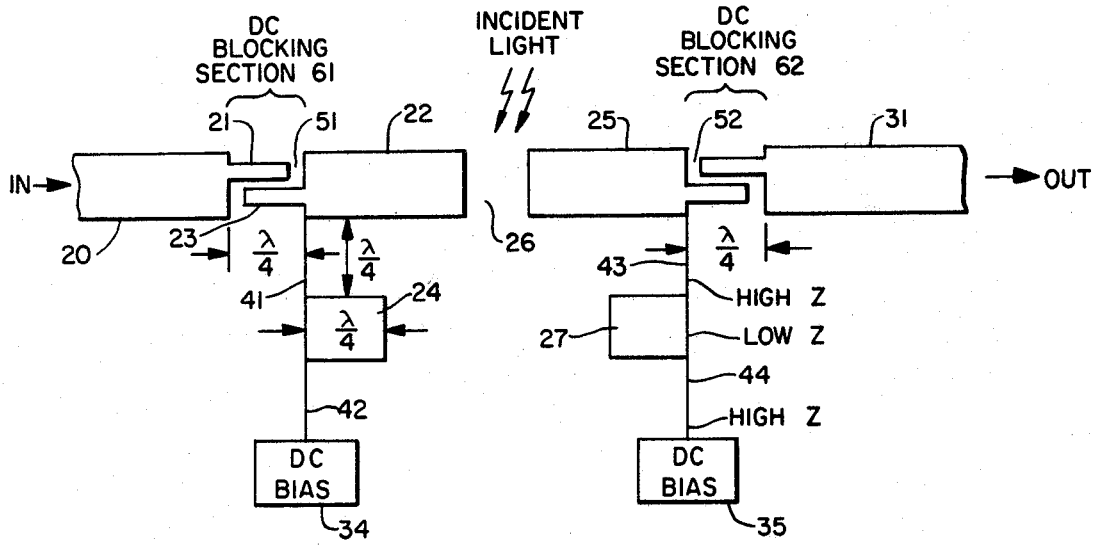
FIG. 3 is a plan view of a second embodiment of an optically controlled microwave switch according to the present invention.

In place of the depletion region-creating ribbon electrode in the gap between microstrip conductor layers 10 and 13 in the first embodiment of the present invention described above in conjunction with FIGS. 1 and 2, a variation in the isolation structure in which the depletion region-generating ribbon electrode is omitted may be employed. Referring to FIG. 3, which shows a plan view of the layout of the microstrip conductor layers atop the active layer of a second embodiment of the invention, the microstrip conductor sections are formed of layers 20, 22, 25, and 31. Between sections 22 and 25, a gap 26 is provided upon which light is controllably directed to turn the microstrip switch on and off. In the present embodiment, a D.C. bias with R.F. isolation arrangement is provided by separating microstrip conductor sections 20 and 22 from each other via a D.C. blocking section 61 and separating microstrip conductor sections 25 and 31 from each other via a D.C. blocking section 62. Microstrip conductor layer 20 has a narrow extension or finger 21 extending toward but spaced apart from microstrip conductor section 22. A similar finger 23 extends from microstrip conductor section 22 toward section 20, with a gap 51 separating spaced apart edges of fingers 21 and 23 and sections 20 and 22 from each other. The extent of the separation between sections 20 and 22 is on the order of a quarter wavelength of the microwave frequency of interest to be selectively coupled over the optically controlled microstrip switch.

A D.C. bias termination for microstrip section 22 is provided by way of a pair of high impedance microstrip lines 41 and 42 and a low impedance line 24 disposed therebetween, connected between conductor section 22 and D.C. bias source 34. The length of each of high impedance lines 41 and 42 is on the order of a quarter wavelength of the microwave frequency of interest. Similarly, low impedance line 24 is a quarter wavelength section so as to provide an effectively terminating non-reflecting stub in the D.C. bias line.

A similar configuration is provided for microstrip sections 25 and 31, each of which has a respective finger 28 and 32 extending towards one another with a gap 52 therebetween and the extent of the separation being on the order of a quarter wavelength of the microwave frequency of interest. D.C. bias is provided by way of a pair of high impedance microstrip lines 43 and 44, and a low impedance line 27 disposed therebetween. These lines interconnect the D.C. bias source 35 to conductor section 25.

With the above configuration, D.C. isolation between microstrip sections 20 and 31 is provided by way of blocking sections 61 and 62; however, the required D.C. bias to insure proper signal levels is provided by D.C. bias sources 34 and 35 which are connected to adjacent but separated microstrip sections 22 and 25. The D.C. bias is provided with R.F. isolation through the high and low impedance quarter wavelength connecting lines between the D.C. bias sources and sections 22 and 25.

Control of the operation of the switch is effected by directing light upon gap 26 between opposite ends of conductive layers 22 and 25, so as to photo-induce carriers in the gap and interconnect layers 22 and 25 to each other through the active layer upon which the microstrip conductors are disposed. When the light is turned off, the signal path is interrupted, although the absence of a depletion region within the gap 26 is not as effective as providing input/output isolation between the sections of the microstrip. However, by way of the D.C. bias and R.F. bias isolation configuration of the microstrip lines, intended signal control for the microwave frequency of interest is obtained.

Figure 4:
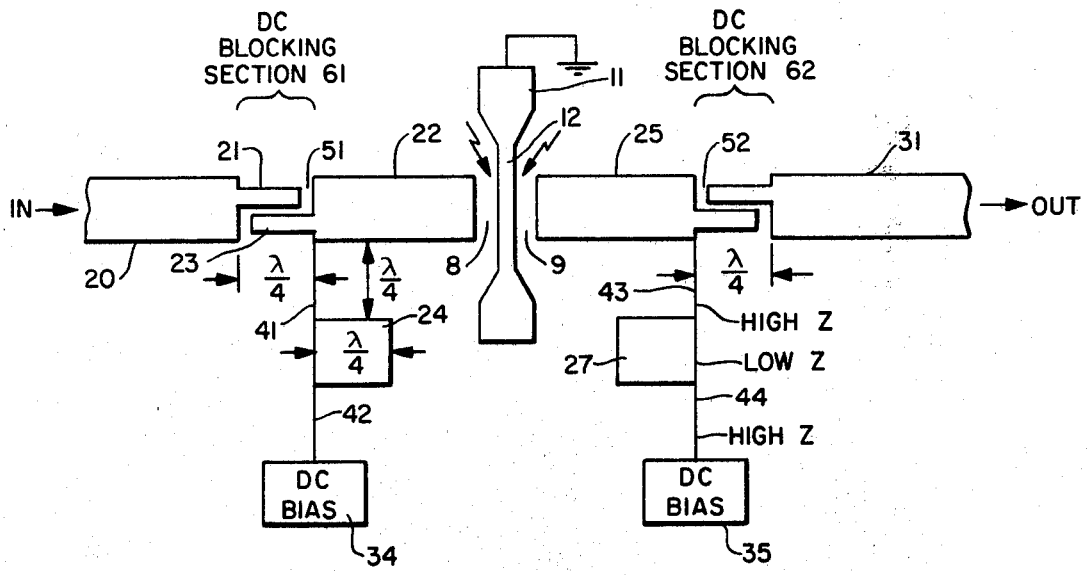
FIG. 4 is a plan view of a third embodiment of an optically controlled microwave switch according to the present invention.

An especially effective optically controlled microwave switch may be obtained by combining the structures of FIGS. 1 through 3 in a configuration shown in FIG. 4. In effect, FIG. 4 corresponds to FIG. 3 with the additional insertion of the input/output isolating electrode 11 disposed in the gap 26 between microstrip conductor regions 22 and 25. Thus, signal level control via the D.C. bias and R.F. isolation of the embodiment shown in FIG. 3 as well as input/output isolation through the use of the depletion region inducing electrode 11 disposed in the gap are both affored to provide a significantly enhanced optically controlled microwave signal switch.

In the embodiments shown in FIGS. 3 and 4, the quarter wavelength high and low impedance sections provide R.F. isolation for the D.C. bias sources 34 and 35, as pointed out above. No power is consumed during the off mode of the switch. It is to be noted, in conjunction with the application of this switch to microwave signals of interest, that the characteristic impedance of the coupling line may be calculated from the expression $Zo=(ZoeZoo)^{\frac{1}{2}}$, where Zoe and Zoo are the even-mode and odd-mode characteristic impedances, respectively. These impedances may be determined in a straightforward manner by the width of the microstrip line and the gap width.

While I have shown and described several embodiment in accordance with the present invention, it is understood that the same is not limited thereto but is susceptible of numerous changes and modifications as are known to a person skilled in the art, and I therefore do not wish to be limited to the details shown and described herein but intend to cover all such changes and modifications as are obvious to one of ordinary skill in the art.

What is claimed:

1. An apparatus comprising:

a body of semiconductor material having a major surface upon which are disposed first and second electrode segments separated by a gap;

first means, coupled with said semiconductor body at said gap, for establishing a depletion region in said semiconductor body in said gap; and second means for illuminating said gap with radiation sufficient to modify said depletion region and to produce charge carriers in said semiconductor material so as to provide a complete electrical path through said semiconductor material between said first and second electrode segments.

2. An apparatus according to claim 1, wherein said first means comprises a third electrode segment disposed upon said major surface in said gap and being separated from said first and second electrodes.

3. An apparatus according to claim 2, wherein said third electrode segment is coupled to a source of reference potential.

4. An apparatus according to claim 3, wherein said reference potential is ground potential.

5. An apparatus according to claim 1, wherein said body of semiconductor material comprises a layer of active semiconductor material of a prescribed conductivity type disposed upon a support substrate, the thickness of said layer being substantially less than that of said support substrate.

6. An apparatus according to claim 5, wherein said semiconductor material is GaAs.

7. An optically controlled switch comprising:

a body of semiconductor material having a major surface upon which is disposed a microstrip transmission line having a gap therein thereby dividing said microstrip transmission line into first and second electrode segments;

first means, coupled with said semiconductor body at said gap, for establishing a depletion region in said semiconductor body between said first and second electrode segments so as to provide signal isolation therebetween; and second means, optically coupled with said gap, for illuminating said gap with radiation sufficient to produce charge carriers in said semiconductor material so as to provide a complete electrical path between said first and second electrode segments, through said semiconductor material and around said depletion region.

8. An apparatus according to claim 7, wherein said first means comprises a third electrode segment disposed upon said major surface in said gap and being separated from said first and second electrodes.

9. An apparatus according to claim 8, wherein said third electrode segment is coupled to a source of reference potential.

10. An apparatus according to claim 8, wherein said body of semiconductor material comprises a layer of active semiconductor material of a prescribed conductivity type disposed upon a support substrate, the thickness of said layer being substantially less than that of said support substrate.

11. An apparatus comprising:

a body of semiconductor material having a major surface upon which ai disposed first and second electrode segments separated by a gap; and means for illuminating said gap with radiation sufficient to produce charge carriers in said semiconductor material so as to provide a complete electrical path between said first and second electrode segments through said semiconductor material; and wherein at least one of said electrode segments has a separation therein which provides D.C. isolation between that portion of said at least one electrode segment adjacent said gap and another portion of said at least one electrode segment.

12. An apparatus according to claim 11, wherein each of said first and second electrode segments therein has a respective separation therein which provides D.C. isolation between those portions of said electrode segments adjacent said gap and other portions of said electrode segments.

13. An apparatus according to claim 11, wherein said at least one of said electrode segments is coupled to a source of D.C. bias potential.

14. An apparatus according to claim 12, wherein each of said first and second electrode segments are coupled to D.C. bias potential.

15. An apparatus according to claim 13, wherein said at least one of said electrode segments is coupled to said source of D.C. bias potential through an A.C. signal isolation link.

16. An apparatus according to claim 15, wherein said A.C. signal isolation link comprises at least one quarter wavelength high impedance line coupled with a quarter wavelength terminating low impedance section, where the wavelength is that of a signal to be coupled over said first and second electrode segments.

17. An apparatus according to claim 14, wherein each of said electrode segments is coupled to a source of D.C. bias potential through an A.C. signal isolation link.

18. An apparatus according to claim 17, wherein said A.C. signal isolation link comprises at least one quarter wavelength high impedance line coupled with a quarter wavelength terminating low impedance section, where the wavelength is that of a signal to be coupled over said first and second electrode segments.

19. An apparatus according to claim 11, further comprising means, coupled with said semiconductor body at said gap, for establishing a depletion region in said semiconductor body between said first and second electrode segments so as to provide signal isolation therebetween.

20. An apparatus according to claim 19, wherein said first means comprises a third electrode segment disposed upon said major surface in said gap and being separated from said first and second electrodes.

21. An apparatus according to claim 20, wherein said third electrode segment is coupled to a source of reference potential.

22. An apparatus according to claim 21, wherein said body of semiconductor material comprises a layer of active semiconductor material of a prescribed conductivity type disposed upon a support substrate, the thickness of said layer being substantially less than that of said support substrate.

23. An apparatus comprising:

a body of semiconductor material having a major surface upon which are disposed first and second electrode segments separated by a gap; and means for illuminating said gap with radiation sufficient to produce charge carriers in said semiconductor material so as to provide a complete electrical path between said first and second electrode segments through said semiconductor material; and wherein at least one of said electrode segments is coupled to a source of D.C. bias potential through an A.C. signal isolation link.

24. An apparatus according to claim 23, further comprising means, coupled with said semiconductor body at said gap, for establishing a depletion region in said semiconductor body between said first and second electrode segments so as to provide signal isolation therebetween.

25. An apparatus according to claim 23, wherein said A.C. signal isolation link comprises at least one quarter wavelength high impedance line coupled with a quarter wavelength terminating low impedance section, where the wavelength is that of a signal to be coupled over said first and second electrode segments.

26. An apparatus according to claim 24, wherein each of said electrode segments is coupled to a source of D.C. bias potential through an A.C. signal isolation link.

27. An apparatus according to claim 26, wherein said A.C. signal isolation link comprises at least one quarter wavelength high impedance line coupled with a quarter wavelength terminating low impedance section, where the wavelength is that of a signal to be coupled over said first and second electrode segments.

28. An apparatus according to claim 24, wherein said first means comprises a third electrode segment disposed upon said major surface in said gap and being separated from said first and second electrodes.

29. An apparatus according to claim 28, wherein said third electrode segment is coupled to a source of reference potential.

30. An apparatus according to claim 29, wherein each of said electrode segments is coupled to a source of D.C. bias potential through an A.C. signal isolation link.

31. An apparatus according to claim 30, wherein said A.C. signal isolation link comprises at least one quarter wavelength high impedance line coupled with a quarter wavelength terminating low impedance section, where the wavelength is that of a signal to be coupled over said first and second electrode segments.

* * * * *